US006513911B1

(12) United States Patent
Ozaki et al.

(10) Patent No.: US 6,513,911 B1
(45) Date of Patent: Feb. 4, 2003

(54) MICRO-ELECTROMECHANICAL DEVICE, LIQUID DISCHARGE HEAD, AND METHOD OF MANUFACTURE THEREFOR

(75) Inventors: Teruo Ozaki, Yokohama (JP); Akihiro Yamanaka, Kawasaki (JP); Yoshiyuki Imanaka, Kawasaki (JP); Masahiko Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/577,979

(22) Filed: May 25, 2000

(30) Foreign Application Priority Data

Jun. 4, 1999 (JP) ..... 11-158646

(51) Int. Cl.[7] ..... B41J 2/05
(52) U.S. Cl. ..... 347/58; 347/65
(58) Field of Search ..... 347/50, 65, 58, 347/63

(56) References Cited

U.S. PATENT DOCUMENTS 5,580,468 A 12/1996 Fujikawa et al. ..... 216/27

FOREIGN PATENT DOCUMENTS

EP 739734 * 10/1996 ..... 347/65
EP 0 899 104 3/1999

* cited by examiner

*Primary Examiner*—Craig Hallacher
*Assistant Examiner*—Michael S Brooke
(74) *Attorney, Agent, or Firm*—Fitzpatrick, Cella, Harper & Scinto

(57) ABSTRACT

A micro-electromechanical device comprises a movable member having a fixedly supporting portion and movable portion, and a substrate for having the movable member which is supported in a state having a specific gap with the substrate. For this device, a metallic layer which provides the gap for the movable portion is covered by the fixedly supporting portion of the movable member, and remains to be used as a wiring layer. The wiring layer is electrically connected with a plurality of wiring provided for the substrate. With the structure, thus arranged, the electric resistance is made significantly small. The electrical efficiency is enhanced accordingly. Also, the apparatus that adopts this device is made smaller, and the costs of manufacture thereof is made lower as well.

4 Claims, 11 Drawing Sheets

MICRO-ELECTROMECHANICAL DEVICE, LIQUID DISCHARGE HEAD, AND METHOD OF MANUFACTURE THEREFOR

BACKGROUND OF THE INVENTION

1. Field of the Invention

The present invention relates to a micro-electromechanical device, a liquid discharge head, and a method of manufacture therefor.

2. Related Background Art

The liquid discharge head, which is one example of the micro-electromechanical device used conventionally. for an ink jet printer or the like, is such that liquid in each of the flow paths is heated and bubbled by means of heating elements, respectively, and that liquid is discharged from each of the discharge ports by the application of pressure exerted when liquid is bubbled. Each of the heating elements is arranged on an elemental substrate, and driving voltage is supplied to each of them through wiring on the elemental substrate.

For a liquid discharge head of the kind, there is a structure in which a movable member is arranged in the flow path in a cantilever fashion where one end of the movable member is supported. One end (fixedly supported portion) of this movable member is fixed onto the elemental substrate, while the other end (movable portion) is made extendable into the interior of each liquid flow path. In this manner, each movable member is supported on the elemental substrate with a certain gap with the surface thereof, and arranged to be displaceable in each flow path by the pressure exerted by bubbling or the like.

For the conventional example described above, the wiring is formed, on the elemental substrate. The wiring is extremely thin, and its resistance value is great. Then, from this elemental substrate, the wiring is connected with the external driving circuit or the like. However, with such large resistance value of the wiring, the electrical loss becomes great inevitably. Also, in order to make the resistance value smaller even by a slight amount, the wiring should preferably be made flat and wide. As a result, the liquid discharge head is formed in a larger size inevitably.

SUMMARY OF THE INVENTION

Now, therefore, the present invention is designed with a view to solving the problems discussed above. It is an object of the invention to provide a micro-electromechanical device capable of reducing the electrical loss of wiring without making the structure complicated or making the size of the device large. It is also the object of the invention to provide a liquid discharge head and a method of manufacture therefor.

In order to achieve the object of the invention discussed above, it has a feature given below.

The micro-electromechanical device of the present invention comprises a fixedly supporting portion and a movable portion, and a substrate for supporting the movable member which is supported in a state having a specific gap with the substrate. For this device, a metallic layer which provides the gap for the movable portion is covered by the fixedly supporting portion of the movable member, and remains to be used as a wiring layer.

Also, the wiring layer is electrically connected with a plurality of wiring provided for the substrate.

Another feature of the- present invention is the provision of a liquid discharge head comprising an elemental substrate; a ceiling plate laminated on the elemental substrate; a flow path formed between the elemental substrate and the ceiling plate and a movable member each having a fixedly supporting portion and a movable portion, the movable portion of which is positioned in each of the flow paths. Here, the movable member is supported in a state having a specific gap with the elemental substrate. For this liquid discharge head, a metallic layer for providing the gap for the movable portion is covered by the fixedly supporting portion of the movable member, and remains to be used as a wiring layer.

Also, this liquid discharge head, a heating element is provided for the elemental substrate corresponding to the flow path, and the aforesaid wiring layer may be electrically connected with the heating element through wiring.

With the structure thus arranged, at least a part of the metallic layer that forms a sufficiently thick gap can be utilized as wiring, hence making it possible to reduce the value of electric resistance.

Also, a method of the present invention for manufacturing a liquid discharge head, which is provided with an elemental substrate, a ceiling plate laminated on the elemental substrate, and a flow path formed between the elemental substrate and the ceiling plate, comprises the steps of forming a metallic layer for the formation of a gap on the elemental substrate; forming a thin film layer on the metallic layer to become a movable member removing a portion of the metallic layer positioned below the movable portion of the movable member, while keeping the portion of the movable member positioned below the fixedly supporting portion to remain intact; and making at least a part of the remaining portion of the metallic layer as a wiring layer to be electrically connected with the wiring pattern on the elemental substrate.

Here, the thin film layer is formed by SiN, and the metallic layer is formed by Al or may be formed by Al alloy.

In this respect, the term "upstream" and the term "downstream" referred to in the description hereof are used to express the flow direction of liquid from the liquid supply source toward the discharge ports through the bubbling areas (or movable members) or to express the structural directions.

DETAILED DESCRIPTION OF THE PREFERRED EMBODIMENTS

Now, the description will be made of a liquid discharge head as one embodiment to which the present invention is applicable, which comprises a plurality of discharge ports for discharging liquid; a first substrate and a second substrate, which are bonded together to form a plurality of liquid flow paths communicated with each of the discharge ports; a plurality of energy converting elements arranged in each of the liquid flow paths for converting electric energy to energy for discharging liquid in each liquid flow path; and a plurality of elements having different functions or electric circuits for controlling the driving condition of each of the energy converting elements.

Figure 1:
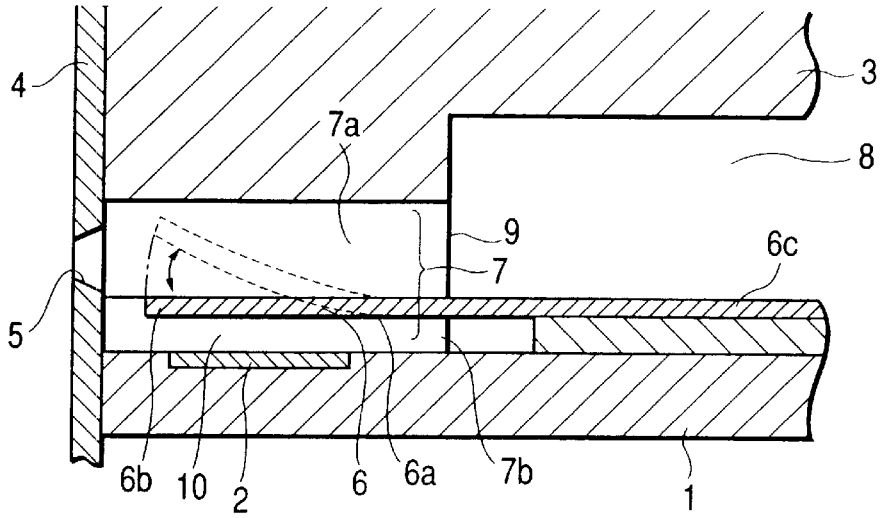
FIG. 1 is a cross-sectional view which illustrates the structure of a liquid discharge head in accordance with one embodiment of the present invention, taken in the liquid flow direction.

FIG. 1 is a cross-sectional view which shows the leading end portion of a liquid discharge head schematically in accordance with one embodiment of the present invention, taken in the liquid flow direction.

As shown in FIG. 1, the liquid discharge head is provided with the elemental substrate 1 having the plural numbers (in FIG. 1, only one is shown) of heating elements 2 arranged in parallel lines, which generate thermal energy for creating bubbles in liquid; the ceiling plate 3 which is bonded to the elemental substrate 1; the orifice plate 4 bonded to the front faces of the elemental substrate 1 and ceiling plate 3; and movable member 6 installed in the liquid flow paths 7 formed by the elemental substrate 1 and the ceiling plate 3.

The elemental substrate 1 is the one having a silicon oxide or silicon nitride film formed on the substrate of silicon or the like for insulation and heat accumulation, and also, having thereon the electric resistive layer and wiring formed by patterning, thus making each of the heating elements 2. Each of the heating elements 2 generates heat when voltage is applied from the wiring to the electric resistive layer to enable electric current to run on it.

The ceiling plate 3 is the one that forms a plurality of liquid flow paths 7 corresponding to each of the heating elements 2, and a common liquid chamber 8 for supplying liquid to each of the liquid flow paths 7. The ceiling plate 3 is integrally formed with the liquid path side walls 9 that extend between each of the heating elements 2 from the ceiling portion. The ceiling plate is formed by silicon material to be able to provide the patterns of the liquid flow paths 7 and the common liquid chamber 9 by means of etching, or to form the liquid flow path 7 portion by means of etching after depositing the material that becomes the liquid flow path side wails 9, such as silicon nitride, silicon oxide, on the silicon substrate by the known film formation method of CVD or the like.

For the orifice plate 4, a plurality of discharge ports 5 are formed corresponding to each of the liquid flow paths 7, and communicated respectively with the common liquid chamber 8 through the liquid flow paths 7. The orifice plate 4 is also formed by silicon material. For example, this plate may be formed by cutting the silicon substrate used for forming the discharge ports 5 to a thickness of approximately 10–150 $\mu$m. In this respect, the orifice plate 4 is not necessarily among the constituents of the present invention. Instead of the provision of the orifice plate 4, it may be possible to make a ceiling plate with discharge ports 5 by processing the front end face of the ceiling plate 3 to leave a wall intact in a thickness equivalent to that of the orifice plate 4 when the liquid flow paths 7 are formed on the ceiling plate 3.

The movable member 6 is a thin film in the form of a cantilever which is arranged to face the heating element 2 and divide the first liquid flow path 7*a* communicated with. the discharge port 5 of the liquid flow path 7 into the second liquid flow path 7*b*. Each of the movable members is formed by a silicon insulation material, such as silicon nitride, silicon oxide.

The movable member 6 is arranged in a position to face the heating element 2 with a specific distance from the heating element 2 in a state to cover the heating element 2 so that the fixedly supporting portion 6*c* is provided for this member on the upstream side of a large flow which runs by the discharge operation of liquid from the common liquid chamber 8 to the discharge port 5 side through the movable member 6, and that the movable portion 6*b* is provided for this member on the downstream side with respect to the fixedly supporting portion 6*c*. The gap between the heating element 2 and the movable member 6 becomes each of the bubbling areas 10.

Now, when the heating element 2 is driven to give heat in accordance with the structure described above, heat is applied to liquid on the bubbling area 10 between the movable member 6 and the heating element 2. Then, on the heating element 2, bubbles are generated and developed by film boiling phenomenon. The pressure exerted by the development of each bubble acts upon the movable member 6 priorly to enable the movable member 6 to be displaced to open widely to the discharge port 5 side centering on the fulcrum 6*a* as indicated by broken line in FIG. 1. Due to the displacement of the movable member 6 or due to being in the displaced state of the movable member, the propagation of the pressure and the development of the bubble itself brought about by the generation of the bubble are led to the discharge port 5 side, hence discharging liquid from the discharge port 5.

In other words, with the movable member 6 being provided for the bubbling area 10, having the fulcrum 6*a* on the upstream side (common liquid chamber 8 side) of the liquid flow in the liquid flow path 7, and the movable portion 6*b* on the downstream side (discharge port 5 side) thereof, the direction of the bubble pressure propagation is led to the downstream side, thus enabling the bubble pressure to directly contribute to the effective discharge performance. Then, the direction of the bubble development itself is also led to the downstream side in the same way as the direction of the pressure propagation to make develop larger in the downstream side than the upstream side. Now that the direction of the bubble development itself is controlled by the movable member, and also, the direction of the bubble pressure propagation is controlled as described above, it becomes possible to improve the fundamental discharge characteristics, such as the discharge efficiency and discharge power or the discharge speeds, among some others.

Meanwhile, after the ink is discharged, the bubble decreases rapidly. Then, the movable member 6 returns to the initial position, as indicated by the solid line in FIG. 1. At this juncture, liquid is allowed to flow in from the upstream side, that is, the common liquid chamber 8 side, in order to make up the contracted volume of bubble on the bubbling area 10, or to make up the voluminal portion of liquid that has been discharged. Here, the liquid refilling is made in the liquid flow path 7, but this liquid-refilling is performed efficiently along with the return action of the movable member 6.

Also, the liquid discharge head of the present embodiment is provided with the circuits and elements for driving each of the heating elements 2, and also, for controlling the driving thereof. These circuits and elements are arranged on the elemental substrate 1 or on the ceiling plate 3, depending on each of the functions that should be carried out by them as allocated accordingly. Also, these circuits and elements can be formed easily and precisely by the application of the semiconductor wafer processing technologies, because the elemental substrate 1 and the ceiling plate 3 are structured by use of silicon material.

Hereunder, the description will be made of the structure of the elemental substrate 1 formed by the application of the semiconductor wafer processing technologies.

Figure 2:
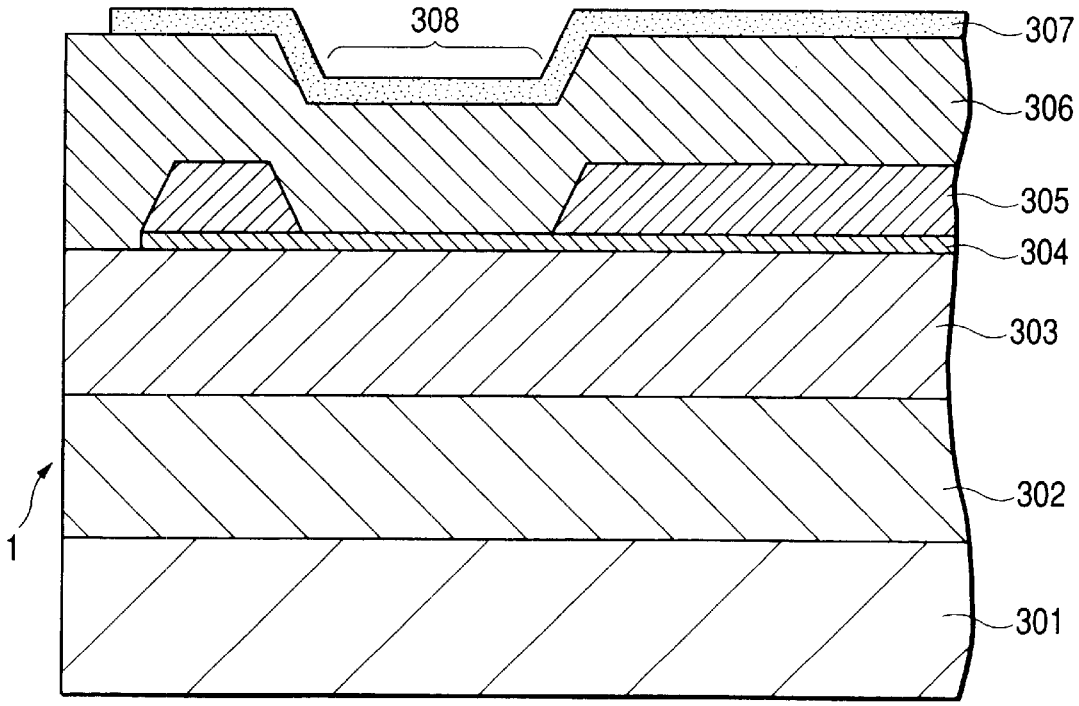
FIG. 2 is a cross-sectional view which shows the elemental substrate used for the liquid discharge head represented in FIG. 1.

FIG. 2 is a cross sectional view which shows the circumference of a heating element on the elemental substrate used for the liquid discharge head represented in FIG. 1. As shown in FIG. 2, the elemental substrate 1 used for the liquid discharge head of the present embodiment is formed by laminating the thermal oxidation film ($SiO_2$ layer in a thickness of approximately 0.55 $\mu$m, for example) 302 and the interlayer film 303 that dually functions as the heat accumulation layer on the surface of the substrate 301 formed by silicon (or ceramics) in that order. As the interlayer film 303, $SiO_2$ film or $Si_3N_4$ film is used. On the surface of the interlayer film 303, a resistive layer (TaN layer in a thickness of approximately 1000 Å, for example) 304 is partly formed. Then, on the surface of the resistive layer 304, the wiring 305 is partly formed. As the wiring 305, Al wiring or Al alloy wiring, such as Al—Si, Al—Cu, in a thickness of approximately 5000 Å is used. The wiring 305 is patterned by the photolithographic method and wet etching method. The resistive layer 304 is patterned by the photolithographic method and dry etching method. On the surface of the wiring 305, resistive layer 304, and interlayer film 303, the protection layer 306 is formed by $SiO_2$ or $Si_3N_4$ in a thickness of approximately 1 $\mu$m. On the portion and the circumference thereof of the surface of the protection film 306, which correspond to the resistive layer 304, the cavitation proof film (SiN layer in a thickness of approximately 2000 Å, for example) 307 is formed in order to protect the protection film 306 from the chemical and physical shocks following the heating of the resistive layer 304. The surface of the resistive layer 304, where the wiring 305 is not formed, becomes the thermoactive portion (heating element) 308 where the heat of the resistive layer 304 is activated.

The films on the elemental substrate 1 are formed one after another on the surface of the silicon substrate 301 by the application of the semiconductor manufacturing technologies and techniques. Thus, the thermoactive portion 308 is provided for the silicon substrate 301.

Figure 3:
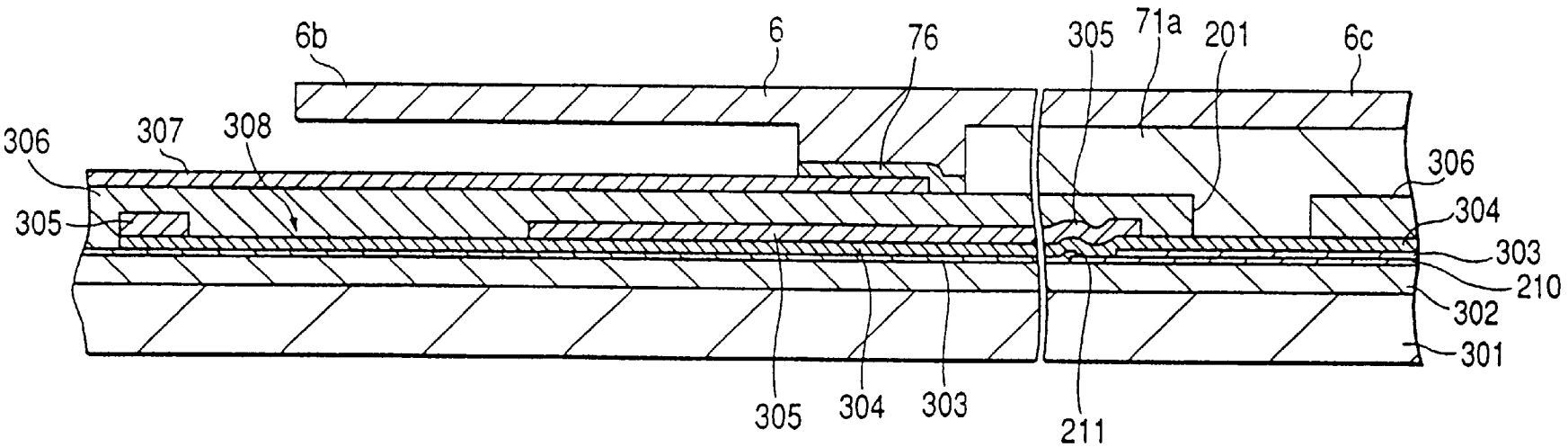
FIG. 3 is a cross-sectional view which illustrates the electrical connection of the liquid discharge head represented in FIG. 1, taken in the liquid flow path.
Figure 4:
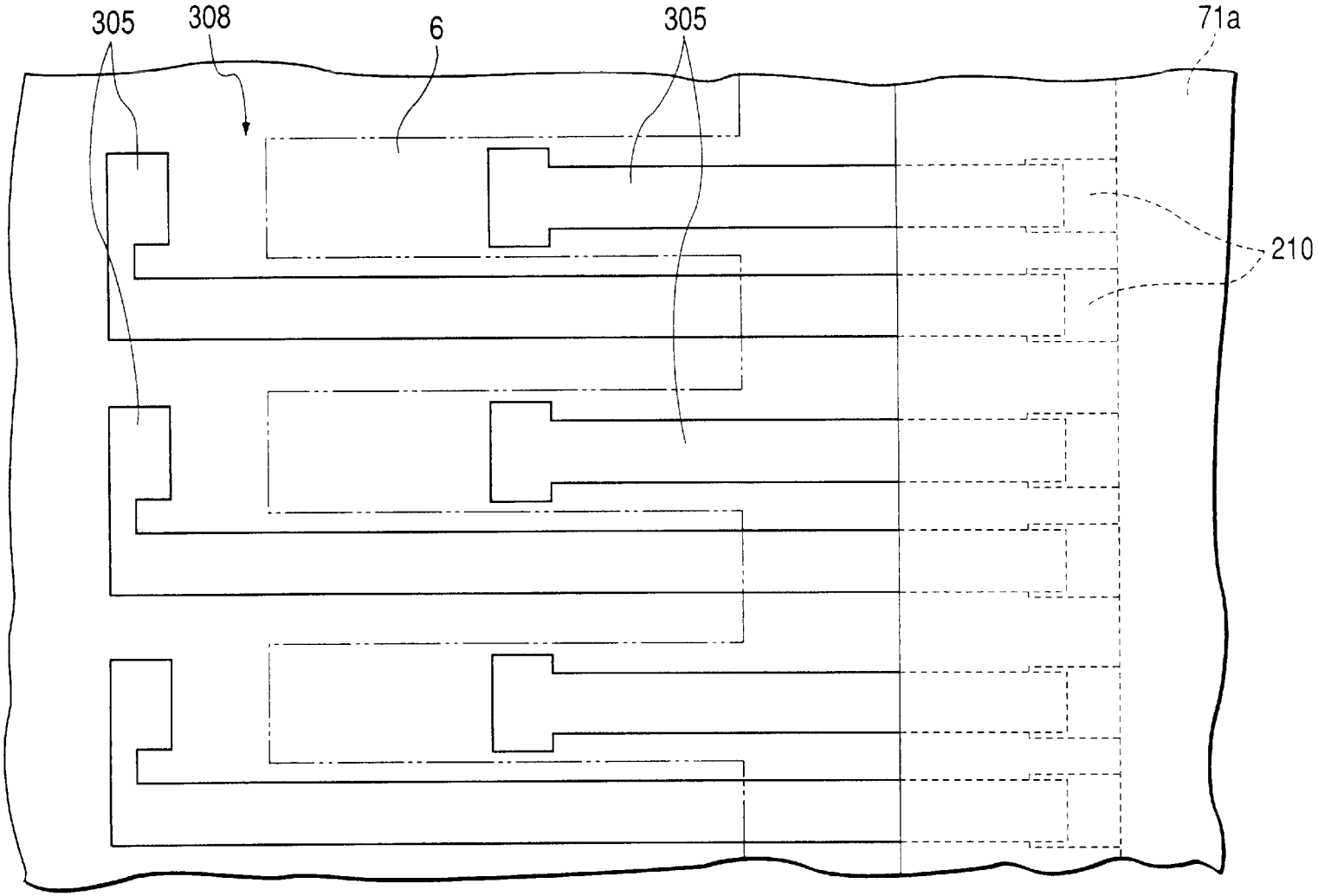
FIG. 4 is a plan view which schematically shows the liquid discharge head represented in FIG. 3 without the protection layer and others.

FIG. 3 is a cross-sectional view which shows in detail the circumference of the fixedly supporting portion of the movable member of the elemental substrate. FIG. 4 is a schematic plan view thereof. As described earlier, the heat accumulation layer 302 and the interlayer film 303 are laminated on the substrate 301. Then, the resistive layer 304 and the wiring 305 are patterned, respectively. Also, in the gap between the interlayer film 303 and the resistive layer 304, the wiring 210 is partly formed. Further, The protection film 306 and the cavitation proof film 307 are laminated. Then, on the part of the interlayer film 303, the through hole 211 is formed. Also, for the protection film 306, the through hole 201 is formed by means of the dry etching or the like.

Figure 11:
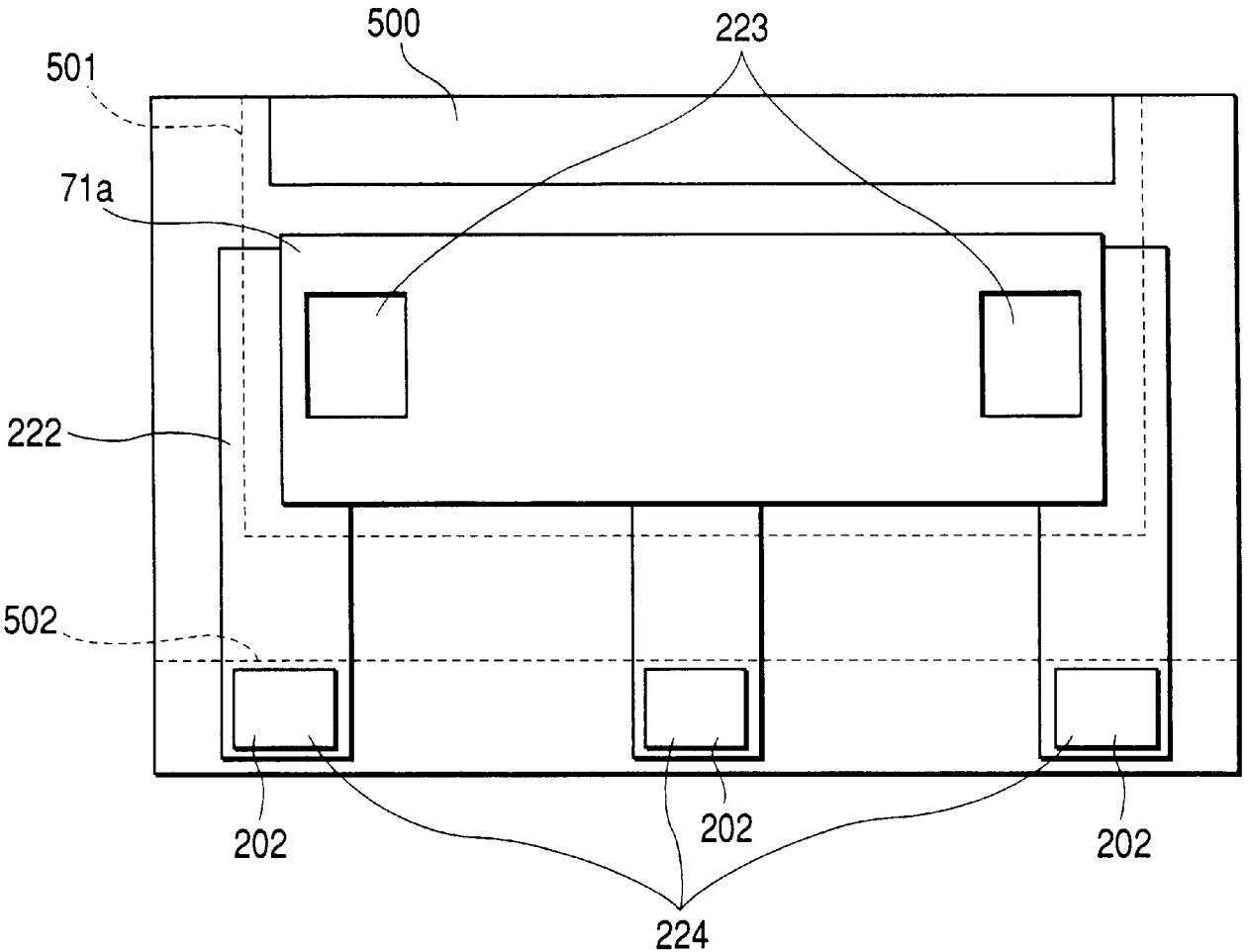
FIG. 11 is a plan view which schematically shows the wiring area on the elemental element of the liquid discharge head in accordance with the first embodiment of the present invention.

Then, by use of the sputtering method, there are formed the metallic layer (Al layer in a thickness of approximately 5 $\mu$m, for example) 71 for the formation of the gap, and the protection layer (TiW layer in a thickness of approximately 3000 Å, for example) 202 (see FIG. 11). The thickness of the metallic layer 71 that forms this gap becomes the gap dimension between the movable member 6 and the resistive layer 304 which serves as the base thereof.

With the structure thus arranged, the wiring 305 is electrically connected with the wiring 210 by way of the through hole 211 and the resistive layer 304. Further, the metallic layer 71 that forms the gaps is electrically connected with the wiring 305 by way of the through hole 201 and the resistive layer 304.

Continuously, then, the SiN thin film layer 72 that becomes the movable member 6 is laminated by the CVD method for its formation in a thickness of 5 $\mu$m. Further, after that, by the photolithographic method and dry etching method, the SiN thin film layer 72 is patterned to form the movable member 6 having the movable portion **6*b* and the fixedly supporting portion 6*c* thereof. At the same time, in accordance with the present invention, the metallic layer 71 that forms the gap should be used as the wiring. Therefore, a part of the Sin thin film layer 72 that becomes the movable member 6 is left intact on a specific location on the surface of the metallic layer 71** for the purpose to enable such part to function as the protection film for the wiring thus arranged.

Then, by means of the wet etching, the portion of the metallic layer 71 that forms the gap, which is positioned below the movable portion **6*b* of the movable member 6 (that is, the remaining portion of the thin film layer 72) is removed together with the other unwanted portions Thus, it is arranged to leave intact the portion of the metallic layer 71 that forms the gap, which is positioned below the fixedly supporting portion 6*c* of the movable portion 6*b* (that is, the remaining portion of the thin film layer 72). This portion is designated as the metallic layer 71*a* that forms the gap. In this way, the movable member 6 is formed with the one end being in the cantilever fashion in which the fixedly supported portion of the movable member is fixed on the metallic layer 71*a* that forms the gap. Lastly, the protection layer 202 formed by TiW (see FIG. 11**) is removed by etching the entire surface of the $H_2O_2$. Then, using the photographic method the electrode pad portion is patterned to compete the elemental substrate.

Here, by the utilization of the metallic layer **71*a*** that forms the gap as the wiring layer, it becomes possible to reduce the resistance value of the wiring approximately by ½ to ⅕ times in total, because the thickness of this layer is made approximately 5 to 10 times the thickness of the conventional one.

Figure 5:
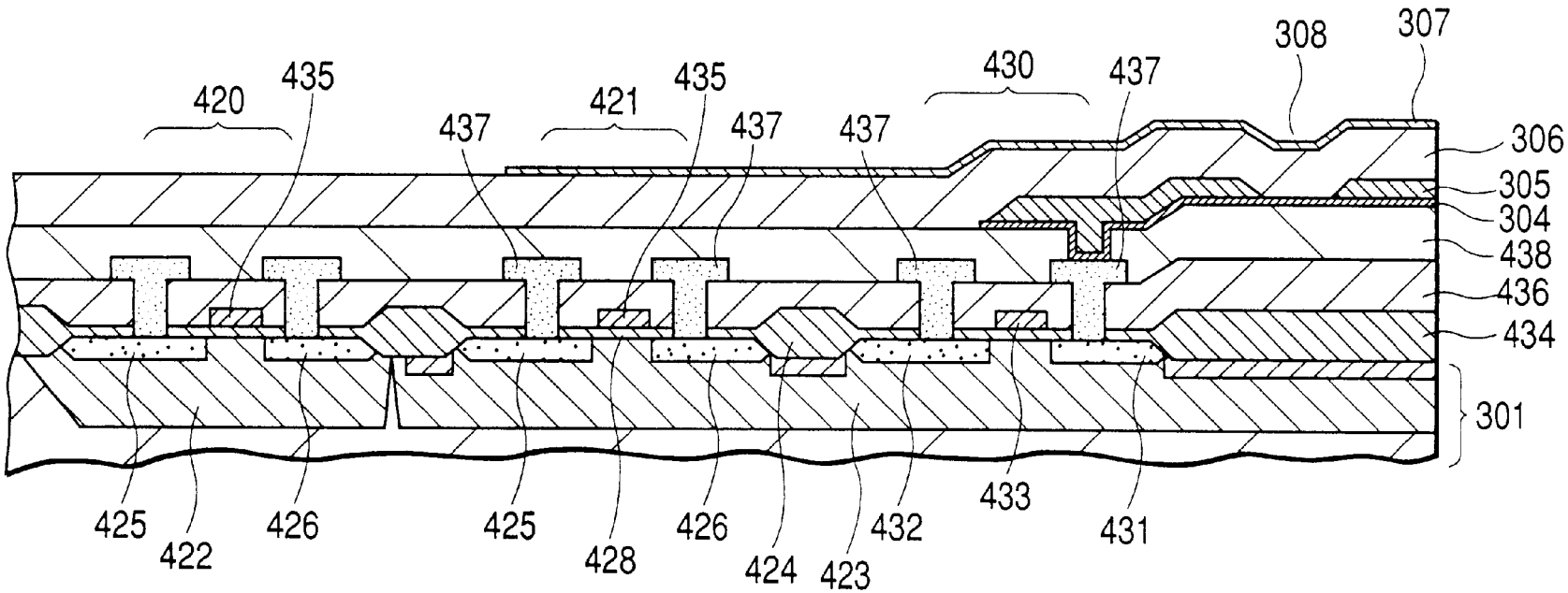
FIG. 5 is a schematically sectional view which shows the elemental substrate by vertically sectioning the principal elements of the elemental substrate represented in FIG. 2.

FIG. 5 is a schematically cross-sectional view which shows the elemental substrate 1 by vertically sectioning the principal elements of the elemental substrate 1 represented in FIG. 2.

As shown in FIG. 5, the N type well region 422 and the P type well region 423 are locally provided for the surface layer of the silicon substrate 301 which is the P conductor. Then, using the general MOS process the P-MOS 420 is provided for the N type well region 422, and the N-MOS 421 is provided for the P type well region 423 by the, execution of impurity plantation and diffusion, such as the on plantation The P-MOS 420 comprises the source region 425 and the drain region 426, which are formed by implanting the N type or P type impurities locally on the surface layer of the N type well region 422, and the gate wiring 435 deposited on the surface of the N type well region 422 with the exception of the source region 425 and the drain region 426 through the gate insulation film 428 which is formed in a thickness of several hundreds of Å, and some others. Also, the N-MOS 421 comprises the source region 425 and the drain region 426, which are formed by implanting the N type or P type impurities locally on the surface layer of the P type well region 423, and the gate wiring 435 deposited on the surface of the P type well region 423 with the exception of the source region 425 and the drain region 426 through the gate insulation film 428 which is formed in a thickness of several hundreds of Å, and some others. The gate wiring 435 is made by polysilicon deposited by the CVD method in a thickness of 4000 Å–5000 Å. Then, the C-MOS logic is structured with the P-MOS 420 and the N-MOS 421 thus formed.

The portion of the P type well region 423, which is different from that of the N-MOS 421, is provided with the N-MOS transistor 430 for driving use of the electrothermal converting element. The N-MOS transistor 430 also comprises the source region 432 and the drain region 431, which are provided locally on the surface layer of the P type well region 423 by the impurity implantation and diffusion process or the like, and the gate wiring 433 deposited on the surface portion of the P type well region 423 with the exception of the source region 432 and the drain region 431 through the gate insulation film 428, and some others.

In accordance with the present embodiment, the N-19 MOS transistor 430 is used as the transistor for driving use of the electrothermal converting element. However, the transistor is not necessarily limited to this one if only the transistor is capable of driving a plurality of electrothermal converting elements individually, and also, obtainable the fine structure as described above.

Between each of the elements, such as between the P-MOS 420 and the N-MOS 421, between the N-MOS 421 and the N-MOS transistor 430, the oxidation film separation area 424 is formed by means of the field oxidation in a thickness of 5000 Å–10000 Å. Then, by the provision of such oxidation, film separation area 424, the elements are separated from each other. The portion of the oxidation film separation area 424, that corresponds to the thermoactive portion 308, is made to function as the heat accumulating layer 434 which is the first layer, when observed from the surface side of the silicon substrate 301.

On each surface of the P-MOS 420, N-MOS 421, and N-MOS transistor 430 elements, the interlayer insulation film 436 of PSG film, BPSG film, or the like is formed by the CVD method in a thickness of approximately 7000 Å. After the interlayer insulation film 436 is smoothed by heat treatment, the wiring is arranged using the Al electrodes 437 that become the first wiring by way of the contact through hole provided for the interlayer insulation film 436 and the get insulation film 428. On the surface of the interlayer insulation film 436 and the Al electrodes 437, the interlayer insulation film 438 of $SiO_2$ is formed by the plasma CVD method in a thickness of 10000 Å–15000 Å. On the portions of the surface of the interlayer insulation film 438, which correspond to the thermoactive portion 308 and the N-MOS transistor 430, the resistive layer 304 is formed with $TaN_{0.8,hex}$ film by the DC sputtering method in a thickness of approximately 1000 Å. The resistive layer 304 is electrically connected with the Al electrode 437 in the vicinity of the drain region 431 by way of the through hole formed on the interlayer insulation film 438. On the surface of the resistive layer 304, the Al wiring 305 is formed to become the second wiring for each of the electrothermal transducing elements. Here, the aforesaid wiring 210 may be the same as the Al electrode 437 without any problem. The protection film 306 on the surfaces of the wiring 305, the resistive layer 304, and the interlayer insulation film 438 is formed with $Si_3N_4$ film by the plasma CVD method in a thickness of 10000 Å. The cavitation proof film 307 on the surface of the protection film 306 is formed with Ta in a thickness of approximately 2500 Å.

Now, the description will be made of a method for manufacturing movable members on an elemental substrate by the utilization of the photolithographic process.

FIGS. 6A to 6E are view which illustrate one example of the method for manufacturing movable members 6 for the liquid discharge head shown in conjunction with FIG. 1. FIGS. 6A to 6E are cross-sectional views taken in the flow path direction of the liquid flow paths 7 shown in FIG. 1. In accordance with the method of manufacture described in conjunction with FIGS. 6A to 6E, the elemental substrate 1 having the movable members 6 formed thereon, and the ceiling plate having the flow path side walls formed thereon are bonded to manufacture the liquid discharge head which is structured as shown in FIG. 1. Therefore, by this method of manufacture, the flow path side walls are incorporated in the ceiling plate before the ceiling plate is bonded to the elemental substrate 1 having the movable members 6 incorporated thereon.

Figure 6A:
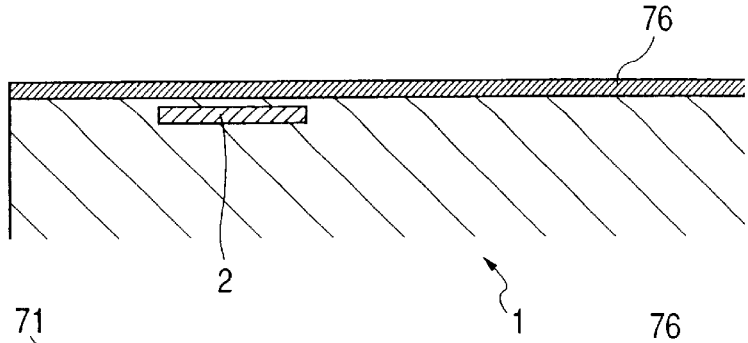
FIGS. 6A, 6B, 6C, 6D and 6E are views which illustrate a method for forming a movable member on an elemental substrate.

At first, in FIG. 6A, the first protection layer of TiW film 76, which protects the pad portion for use of electrical connection with heating elements 2, is formed by the sputtering method in a thickens of approximately 5000 Å on the entire surface of the elemental substrate 1 on the heating element 2 side.

Figure 6B:
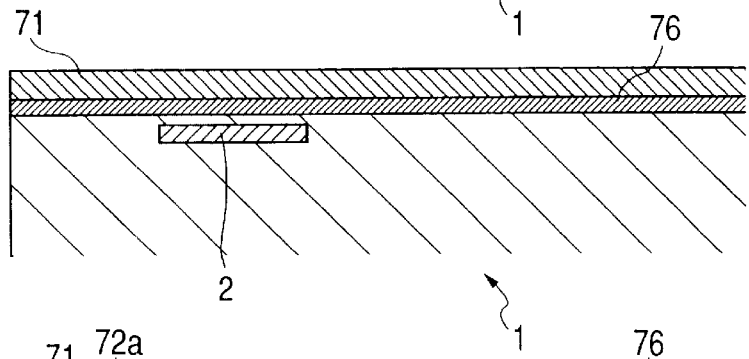

Then, in FIG. 6B, the metallic layer (Al film) 71 is formed by the sputtering method in a thickness of approximately 4 μm on the surface of the TiW film 76 in order to make the gap for the formation of the metallic layer 71*a*. The metallic layer 71 that forms the gap is arranged to extend up to the area where the thin film layer (SiN film) 72*a* is etched in the process shown in FIG. 6D which will be described later.

The metallic layer 71 that forms the gap is the one that forms the gap between the elemental substrate 1 and each movable member 6, which is the Al film. The metallic layer 71 that forms the gap is formed on the entire surface of the TiW film 76 which includes the positions corresponding to each of the bubbling areas 10 between the heating element 2 and the movable member 6 shown in FIG. 1. Therefore, in accordance with this method of manufacture, the metallic layer 71 that forms the gap is formed up to the portion on the surface of the TiW film 76, which corresponds to the flow path side walls.

The metallic layer 71 that forms the gap is made to function as an etching stop layer when the movable members 6 are formed by means of the dry etching, which will be described later. This is because the Ta film that serves as the cavitation proof layer for the elemental substrate 1, and the SiN film that serves as the protection layer on the resistive elements are subjected to being etched by the etching gas used for the formation of the liquid flow paths 7. Thus, in order to prevent the layer and film from being etched, the metallic layer 71 is formed on the elemental substrate 1 that forms the gap on the elemental substrate. In this manner, the surface of the TiW film 76 is not exposed when the SiN film is dry etched for the formation of the movable members 6, and any damages that may be caused to the TiW film 76 and the functional elements on the elemental substrate 1 by the performance of the dry etching are prevented by the provision of the metallic layer 71 that forms the aforesaid gap.

Figure 6C:
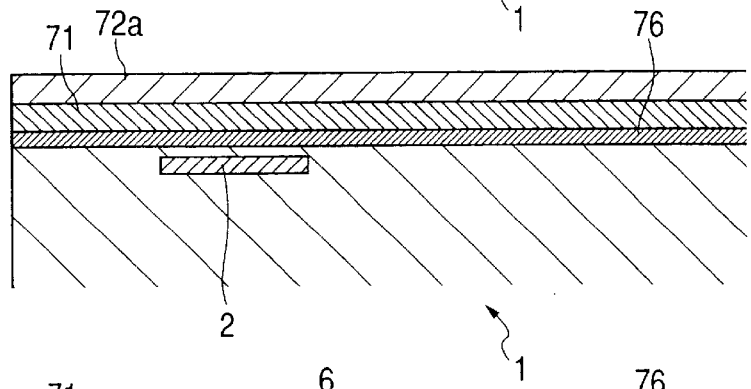

Then, in FIG. 6C, using the plasma CVD method the SiN film (thin film layer) 72*a*, which is the material film for the formation of the movable members 6, is formed in a thickness of approximately 4.5 $\mu$m on the entire surface of the metallic layer 71 that forms the gap, and all the exposed surface of the TiW film 76 so as to cover the metallic layer 71 that forms the gap. Here, when the SiN film 72*a* is formed by use of the plasma CVD apparatus, the cavitation proof film of the Ta provided for the elemental substrate 1 should be grounded through the silicon substrate or the like that forms the elemental substrate 1 as in the description to follow with reference to FIG. 7. In this way, it becomes possible;to protect the heating elements 2 and functional elements, such as latch circuits, on the elemental substrate 1 from the ion seeds decomposed by the plasmic discharges and the radical loads in the reaction chamber of the plasma CVD apparatus.

Figure 7:
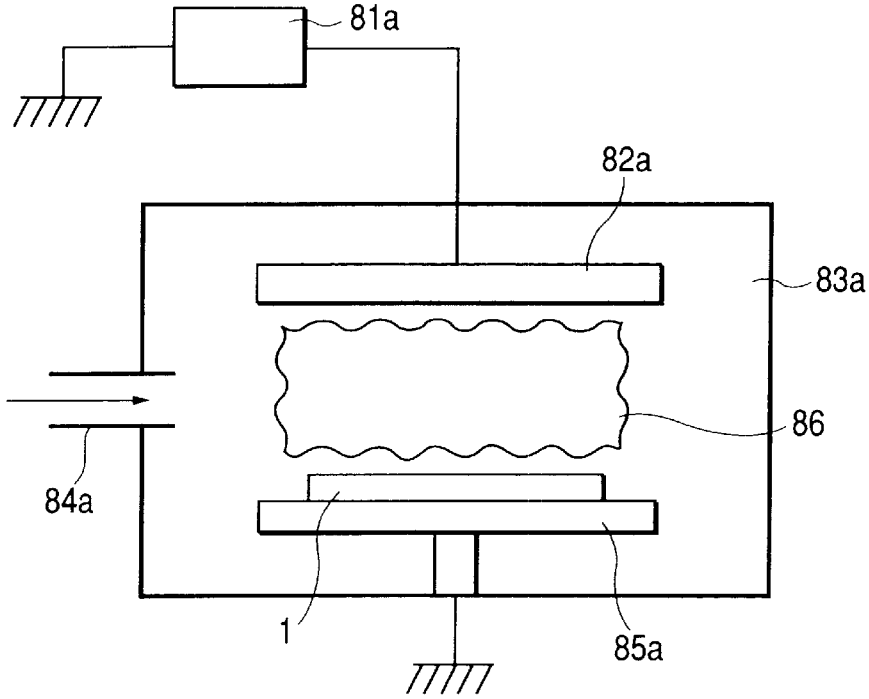
FIG. 7 is a view which illustrate a method for forming SiN film on the elemental substrate by use of a plasma CVD apparatus.

As shown in FIG. 7, the RF electrodes 82*a* and the stage 85*a* are arranged in the reaction chamber 83*a* of the plasma CVD apparatus to face each other with a specific distance between them for the formation of the SiN film 72*a*. To the RF electrodes 82*a*, voltage is applied from the RF supply source 81*a* arranged outside the reaction chamber 83*a*. On the other hand, the elemental substrate 1 is installed on the surface of the stage 85*a* on the RF electrode 82*a* side so that the surface of the elemental substrate 1 on the heating members 2 side is set to face the RF electrodes 82*a*. Here, the cavitation proof film of the Ta formed on the surface of each of the heating members 2 on the elemental substrate 1 is connected electrically with the silicon substrate of the elemental substrate 1. Then, the metallic layer 71 that forms the gap is grounded through the silicon substrate of the elemental substrate 1 and the stage 85*a*.

With the plasma CVD apparatus thus structured, gas is supplied to the interior of the reaction chamber 83*a* through the supply tube 84*a* while the cavitation proof film which is in a state of being grounded, and plasma 46 is generated between the elemental substrate 1 and the RF electrode 82*a*. The ion seed and radical decomposed by the plasmic discharges in the reaction chamber 83*a* are deposited on the elemental substrate 1 to form the SiN film 72*a* on the elemental substrate 1. Then, electric charges are generated by the ion seed and radical on the elemental substrate 1. However, with the cavitation proof film being grounded as described above, it is possible to prevent the heating elements 2 and the functional elements, such as latch circuits, on the elemental substrate 1 from being damaged due to the electric charges.

Figure 6D:
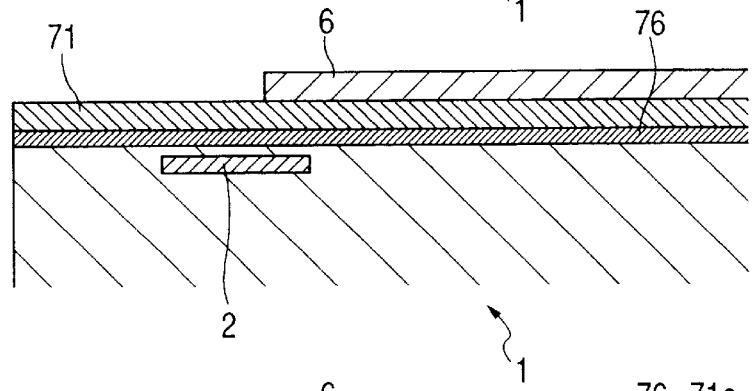

Now, in FIG. 6D, the Al film is formed by sputtering method on the surface of the SiN film 72*a* in a thickness of approximately 6100 Å. After that, the Al film thus formed is patterned by use of the known photolithographic process to. keep the Al film (not shown) remaining as the second protection layer on the portion on the SiN film 72*a* corresponding to the movable member 6. The Al film that serves as the second protection layer becomes the protection layer (etching stop layer), that is, a mask, when the SiN film 72*a* is dry etched to form the movable member 6.

Then, with the etching apparatus that uses dielectric coupling plasma, the SiN film 72*a* is patterned with the second protection layer as the mask to form the movable member 6 which is structured with the remaining portion of the SiN film 72*a*. This etching apparatus uses a mixed gas of $CF_4$ and $O_2$. In the process in which the SiN film 72*a* is patterned, the unwanted portion of the SiN film 72*a* is removed so that the fixedly supporting portion of the movable member 6 is directly fixed on the elemental substrate 1 as shown in FIG. 1. Here, the TiW which is the structural material of the pad protection layer, and the Ta which is the structural .material of the cavitation proof film of the elemental substrate 1 are included in the structural material of the close contact portion between the fixedly supporting portion of the movable member 6 and the elemental substrate 1.

Here, when the SiN film 72*a* is etched by use of the dry etching apparatus, the metallic layer 71 that forms the gap is grounded through the elemental substrate 1 or the like as to be described next with reference to FIG. 8. In this way, it is arranged to prevent the ion seed and radical charges generated by the decomposition of the $CF_4$ gas from residing on the metallic layer 71 that forms the gap at the time of being dry etched, thus protecting the heating elements 2 and the functional elements, such as latch-circuits, of the elemental substrate 1. Also, in this etching process, the metallic layer 71 that forms the gap is produced as described above on the portions of the SiN film 72*a*, which are exposed by removing the unwanted portions, that is, the area to be etched. Therefore, the surface of the TiW film 76 is not exposed, and the elemental substrate 1 is reliably protected by the metallic layer 71 that forms the gap.

Figure 8:
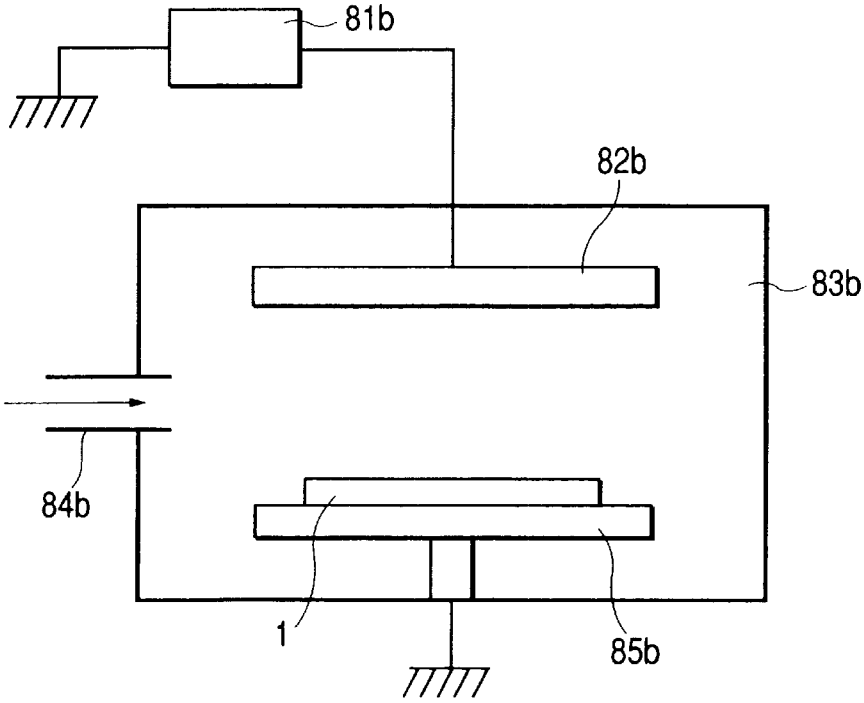
FIG. 8 is a view which illustrate a method for forming SiN film on the elemental substrate by use of a dry etching apparatus.

As shown in FIG. 8, there are arranged the RF electrodes 82*b* and the stage 85*b* to face each other with a specific distance between them in the reaction chamber 83*b* of the dry etching apparatus for etching the SiN film 72*a*. To the RF electrodes 82*b*, voltage is applied from the R,F supply source 81*b* outside the reaction chamber 83*b*. On the other hand, the elemental substrate 1 is installed on the surface of the stage 85*b* on the RF electrode 82*b* side. Then, the surface of the elemental substrate 1 on the heating element 2 side is set to face the RF electrode 82*b*. Here, the metallic layer 71 that forms the gap with the Al film is electrically connected with the cavitation proof film formed by Ta provided for the elemental substrate 1. Then, as described earlier, the cavitation proof film is electrically connected with the silicon substrate of the elemental substrate 1. Therefore, the metallic layer 71, to form such gap is grounded through the cavitation proof film and silicon substrate of the elemental substrate 1, and the stage 85*b* as well.

In the dry etching apparatus thus structured, the $CF_4$ and $O_2$ mixed gas is supplied in the reaction chamber 83*b* through the supply tube 84*b* in the state where the metallic layer 71 that forms the gap is grounded, thus etching the SiN film 72*a*. In this case, electric load is given to the elemental substrate 1 by the ion seed and radical generated by the decomposition of the $CF_4$ gas. However, with the metallic layer 71 that forms the gap which is grounded as described above, it is possible to prevent the heating elements 2 and the functional elements, such as latch circuits, on the elemental substrate 1 from being damaged by the electric discharges generated by the ion seed and radical.

In accordance with the present embodiment, the $CF_4$ and $O_2$ mixed gas is used as the gas to be supplied into the interior of the reaction chamber 83*b*, but it may be possible to use a $CF_4$ gas without $O_2$ mixed or $C_2F_6$ gas or a mixed gas of $C_2F_6$ and $O_2$.

Figure 6E:
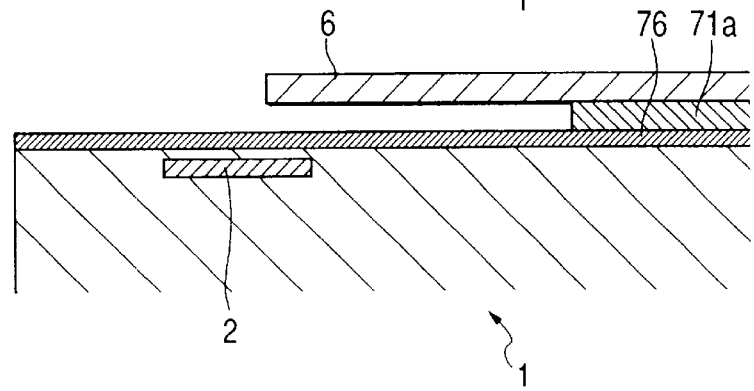

Now, in FIG. 6E, using a mixed acid of acetic acid, phosphoric acid, and nitric acid the second protection layer is liquidated to be removed from the Al film formed for the movable member 6. At the same time, the metallic layer 71 that forms the gap by use of the Al film is partly liquidated to be removed. Then, the metallic layer 71*a* that forms the gap is made by the remaining portion thereof. In this manner, the movable member 6 is incorporated on the elemental substrate 1 which is supported by the metallic layer 71*a* that forms the gap. After that, the portions of the TiW film 76 formed on the elemental substrate 1, which correspond to the bubbling areas 10 and pads, are removed by use of hydrogen peroxide.

For the above example, the description has been made of the case where the flow path side walls 9 are formed for the ceiling plate 3. However, it may be possible to form the flow path side walls 9 on the elemental substrate 1 at the same time when the movable members 6 are formed on the elemental substrate 1 by means of the photolithographic process.

Hereunder, with reference to FIGS. 9A to 9C and FIGS. 10A to 10C, the description will be made of one example of the process in which the movable member 6 and the flow path side walls are formed when the movable members 6 and the flow path side walls 9 are provided for the elemental substrate 1. Here, FIGS. 9A to 9C and FIGS. 10A to 10C illustrate the sections in the direction orthogonal to the direction of the liquid flow paths on the elemental substrate where the movable members and the flow path side walls are formed.

Figure 9A:
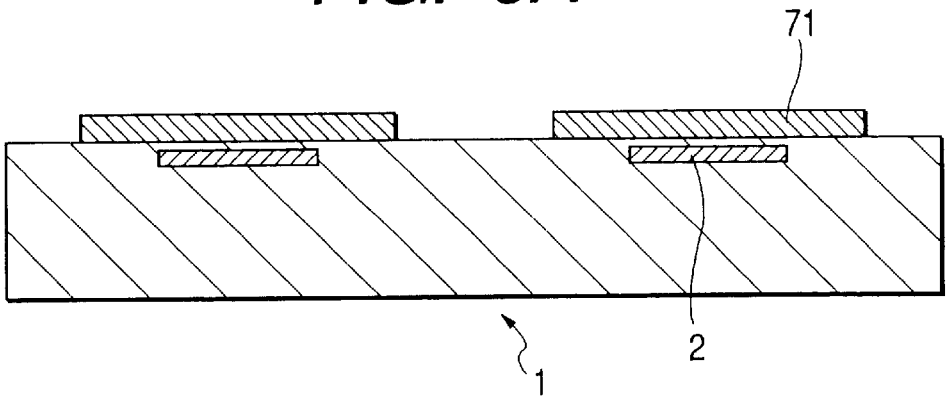
FIGS. 9A, 9B and 9C are views which illustrate a method for forming movable members and flow path side walls on an elemental substrate.

At first, in FIG. 9A, the TiW film which is not shown is formed by the sputtering method in a thickness of approximately 5000 Å on the entire surface of the elemental substrate 1 on the heating element 2 side as the first protection layer which protects the pad portion for use of electrical connection with heating elements 2. Then, the metallic layer (Al film) 71 is formed by the sputtering method in a thickness of approximately 4 $\mu$m on the heating member 2 side of the elemental substrate 1. The Al film thus formed is patterned by the known means of photolithographic process to form a plurality of the metallic layers 71 that form the gaps with Al film, which provide each gap between the movable members 6 and the elemental substrate 1 in the corresponding positions between the heating elements 2 and the movable members 6 shown in FIG. 1. The metallic layer 71 that forms each of the gaps extends up to the area where the SiN film 72, that is, the material film used for the formation of movable members 6, is etched in the process which will be described later in conjunction with FIG. 10B.

The metallic layer 71 that forms each gap functions as the etching stop layer when the liquid flow paths 7 and the movable members 6 are dry etched as described later. This is because the TiW layer that serves as the pad protection layer on the elemental substrate 1, the Ta film that serves as the cavitation proof film, and the SiN film that serves as the protection layer for the resistive elements are etched by the etching gas used when the liquid flow paths 7 are formed. The metallic layer 71 that forms each gap prevents these layer and films from being etched. As a result, when the liquid flow paths 7 are dry etched, the width of the direction of the metallic layer 71 that forms each of the gaps, which is orthogonal to the flow path direction of the liquid flow paths 7, becomes larger than the width of the liquid flow paths 7 formed in the process to be described in conjunction with the FIG. 10B so that the surface of the elemental substrate 1 on the heating element 2 side, and the TiW layer on the elemental substrate 1 are not allowed to be exposed.

Further, the heating elements 2 and the functional elements on the elemental substrate 1 may be damaged by the ion seed and radical generated by the decomposition of $CF_4$ gas at the time of dry etching, but the metallic layer 71 that forms the gaps with Al receives the ion seed and radical and protects the heating elements 2 and functional elements on the elemental substrate 1.

Figure 9B:
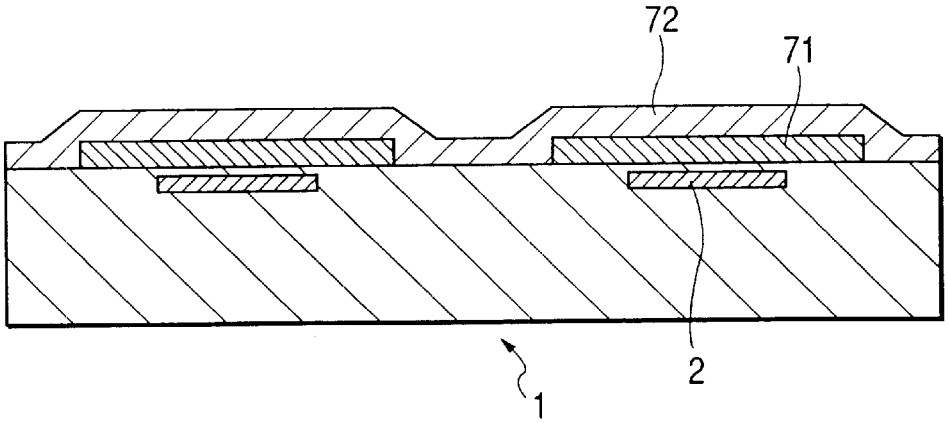

Then, in FIG. 9B, on the surface of the metallic layer 71 that forms each gap, and the surface of the elemental substrate 1 on the metallic layer 71 side that forms each gap, the SiN film (thin film layer) 72, which is the material film for the formation of the movable members 6, is formed in a thickness of approximately 4.5 $\mu$m so as to cover the metallic layer 72 that forms each gap. Here, as described with reference to FIG. 7, the SiN film 72 is formed by use of the plasma CVD apparatus, the cavitation proof film of Ta provided for the elemental substrate 1 is grounded through the silicon substrate or the like that constitutes the elemental substrate 1. In this way, it becomes possible to protect the heating elements 2 and functional elements, such as latch circuits, on the elemental substrate 1 from the charges of the ion seed and radical decomposed by the plasmic discharges in the reaction chamber of the plasma CVD apparatus.

Figure 9C:
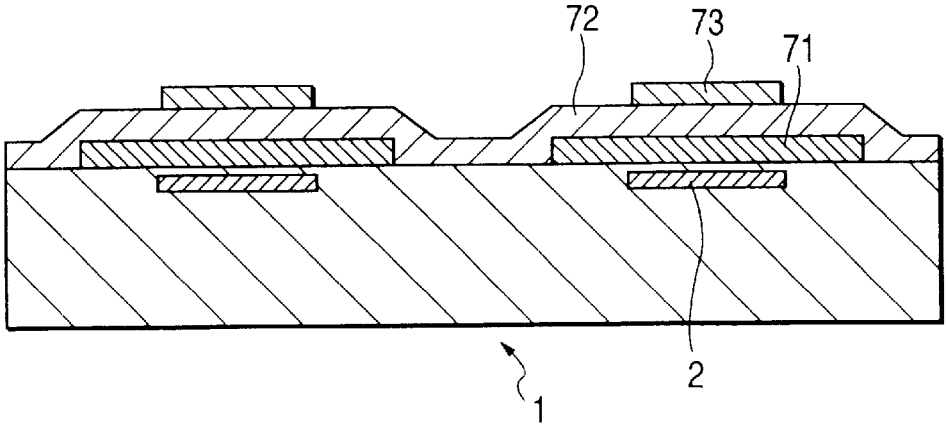

Now, in FIG. 9C, after the Al film is formed on the surface of the SiN film 72 by the sputtering method in a thickness of approximately 6100 Å, the Al film thus formed is patterned by the known means of photolithographic process to leave the Al film 73 in tact as the second protection layer on the portion of the SiN film 72 surface that corresponds to the movable members 6, that is, the movable member formation area on the surface of the SiN film 72. The Al film 73 becomes the protection layer (etching stop layer) when the liquid flow paths 7 are dry etched.

Figure 10A:
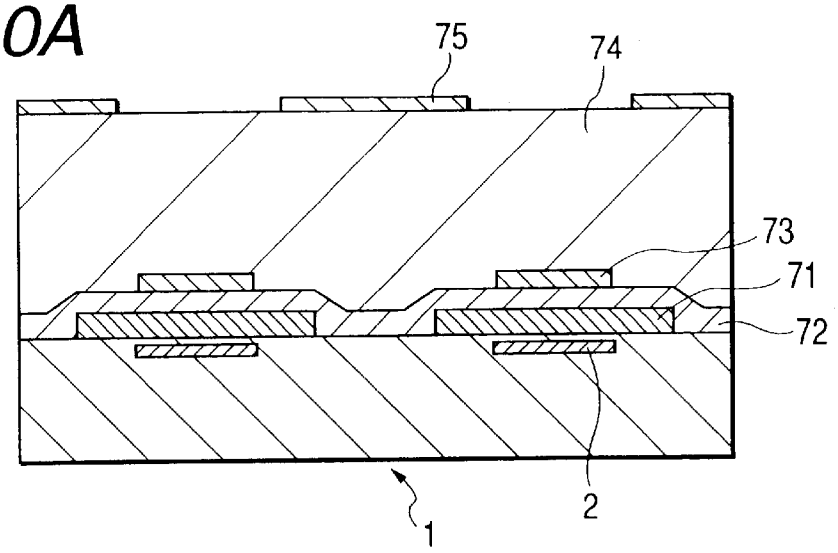
FIGS. 10A, 10B and 10C are views which illustrate a method for forming movable members and flow path side. walls on an elemental substrate.

Then, in FIG. 10A, on the surfaces of the SiN film 72 and the Al film 73, the SiN film 74 for the formation of the flow path side walls 9 is formed by the microwave CVD-method in a thickness of 50 $\mu$m approximately. Here, as the gas used for the microwave CVD method to form the SiN film 74, monosilane ($SiH_4$), nitrogen ($N_2$), and Argon (Ar) are used. As the gas combination, it may be possible to use disilane ($Si_2H_6$), ammonia ($NH_3$), or,the like besides the one described above. Also, the SiN film 74 is formed with the power of the microwave of 1.5 kW at a frequency of 2.45 GHz, and monosilane is supplied at a flow rate of 100 sccm, nitrogen at 100 sccm, and argon at 40 sccm under a high vacuum of 5 mTorr. Here, it may be possible to form the SiN film 74 by the microwave plasma CVD method having other gas composition ratio other than the one described above.

When the SiN film 74 is formed by the CVD method, the cavitation proof film of TA formed on the surface of the heating elements 2 is grounded through the silicon substrate of the elemental substrate 1 as in the case where the SiN film 72 is formed as described in conjunction with FIG. 7. In this way, it becomes possible to protect the heating elements 2 and functional elements, such as latch circuits, on the elemental substrate 1 from the electric charges of the ion seed and radical decomposed by the plasmic discharges in the reaction chamber of the CVD apparatus.

Then, after the Al film is formed on the entire surface of the SiN film 74, the Al film thus formed is patterned by the known photolithographic method to produce the Al film 75 on the portion of the surface of the SiN film with the exception of the portions that correspond to the liquid flow paths 7. As described earlier, the width of the direction of the metallic layer 71 that forms each of the gaps, which is orthogonal to the flow path direction of the liquid flow paths 7, becomes larger than the width of the liquid flow paths 7 formed in the process to be described in conjunction with the FIG. 10B so that the side portion of the Al film 75 is arranged above the side portion of the metallic layer 71 that forms each gap.

Figure 10B:
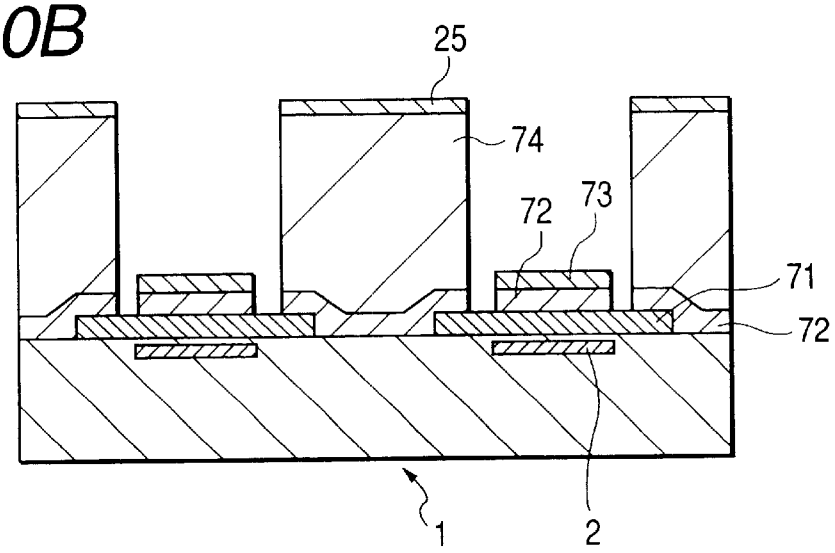

Now, in FIG. 10B, using the etching apparats that uses dielectric coupling plasma the SiN film 74 and the SiN film 72 are patterned to form the flow path side walls 9 and the movable members 6 at a time. The etching apparatus uses a mixed gas of $CF_4$ and $O_2$, and etches the SiN film 74 and the SiN film 72 with the Al films 73 and 25 and the metallic layer 71 that forms each gap as the etching stop layer, that is, a mask so that the SiN film 74 produced in a trench structure. In the process of patterning the SiN film 72, the unwanted portions of the SiN film 72 are removed to enable only the fixedly supporting portion of the movable members 6 to be fixed on the metallic layer 71 that forms each gap as shown in FIG. 1.

Here, when the SiN films 72 and 24 are etched by use of the dry etching apparatus, the metallic layer 71 that forms each gap is grounded through the elemental substrate 1 or the like as described with reference to FIG. 8. In this way, it becomes possible to protect the heating elements 2 and functional elements, such as latch circuits, on the elemental substrate 1 by preventing the electric charge of the ion seed and radical generated by the decomposed gas $CF_4$ from residing on the metallic layer 71 that forms each gap at the time of dry etching. Also, the width of the metallic layer 71 that forms each gap is made larger than that of the liquid flow paths 7 to be formed in the etching process. Therefore, the surface of the elemental substrate 1 on the heating member 2 side is not exposed when the unwanted portions of the SiN film 74 are removed, and the elemental substrate 1 is reliably protected by the metallic layer 71 that forms each gap.

Figure 10C:
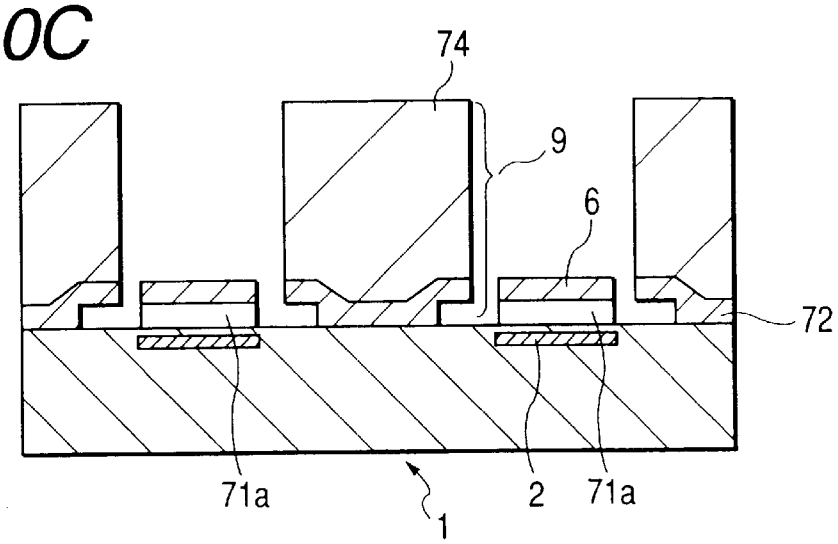

Now, in FIG. 10C, the Al films 73 and 75 are liquidated by use of a mixed acid of acetic acid, phosphoric acid, and nitric acid, and removed by the hot etching of the Al films 73 and 25. At the same time, the metallic layer 71 that forms each gap with the Al film is partly liquidated to be removed. Then, the metallic layer 71*a* that forms each gap is made by the remaining portion thereof. In this manner, the movable members 6 and the flow path side walls 9 are incorporated on the elemental substrate 1. After that, the portions of the TiW film formed on the elemental substrate 1 as the pad protection layer, which correspond to the bubbling areas 10 and pads, are removed by use of hydrogen peroxide. The closely contacted portion between the elemental substrate 1 and the flow path side walls 9 contains the TiW which is. the structural material of the pad protection layer, and the Ta which is the structural material of the capitation proof film of the elemental substrate 1.

As has been described above, in accordance with the present invention, the metallic layer that forms a gap is utilized at least on a part of the wiring that connects between the elemental substrate and the ceiling plate or that connects with the external circuits. This metallic layer that forms the gap is considerably thicker than that of the wiring patterns formed on the elemental substrate, and the electric resistance of the wiring is small.

FIG. 11 is a plan view which schematically shows the substrate in accordance with the first embodiment which has been described earlier. Here, in FIG. 11, the protection layer for covering the metallic layer 71*a* that forms each of the gaps is not represented. Reference numeral 500 denotes a heater arrangement, and portions 501 and 502 denote an inner side and an outer side of liquid chamber frame, respectively.

As shown in FIG. 11, the metallic layer 71*a* is structured to extend in the direction of the heating elements. Then, by way of through hole 223, this layer is connected with the lower layer lead-out electrode 222. Then, voltage can be applied to this lead-out electrode 222 when the electrode pad 224 is connected with the electric connector of the apparatus. With the structure thus arranged, the metallic layer 71*a* that forms each of the gaps is installed in the liquid chamber to make it possible to prevent any excessive steps on the bonding surface of the substrate to the ceiling plate.

In accordance with the present embodiment, the metallic layer 71*a* that forms each of the thick gaps is utilized for wiring to make the electrical resistance small. The electrical resistance is determined by the product of the thickness of wiring and the area thereof. Therefore, it becomes possible to make the whole size of the chip, that constitutes a head, smaller by narrowing the plane width of the wiring pattern without making its electrical resistance higher. In other words, whereas the conventional liquid discharge head needs a comparatively wide space in order to make the width of the wiring larger to reduce the electrical resistance thereof both in the wiring area used for supplying signal voltage, and the ground wiring area, the head of the present embodiment has a thicker metallic layer that forms each of the gaps, where the electric loss is small, thus making it possible to suppress the value of the electric resistance to the same level as the conventional one even if the widths of other wiring portions are made smaller to that extent. Therefore, both the wiring area used for supplying signal voltage and the ground wiring area can be made smaller. Then, the space thus made available can be utilized effectively for the arrangement of other members. Along with this, the wiring area can be arranged compactly to reduce the number of the contact pads accordingly or a liquid discharge head can be made smaller as a whole. In this case, the number of chips that can be manufactured per wafer is increased, and the costs of manufacture can be reduced to that extent.

In other words, the present invention makes electric resistance small, while keeping the size of a chip small, hence making it possible to improve the electrical efficiency. Also, the size of the chip can be made smaller, while keeping the electric resistance appropriately, hence making it possible to attempt reducing the size of apparatus which can be manufactured at lower costs.

Figure 12:
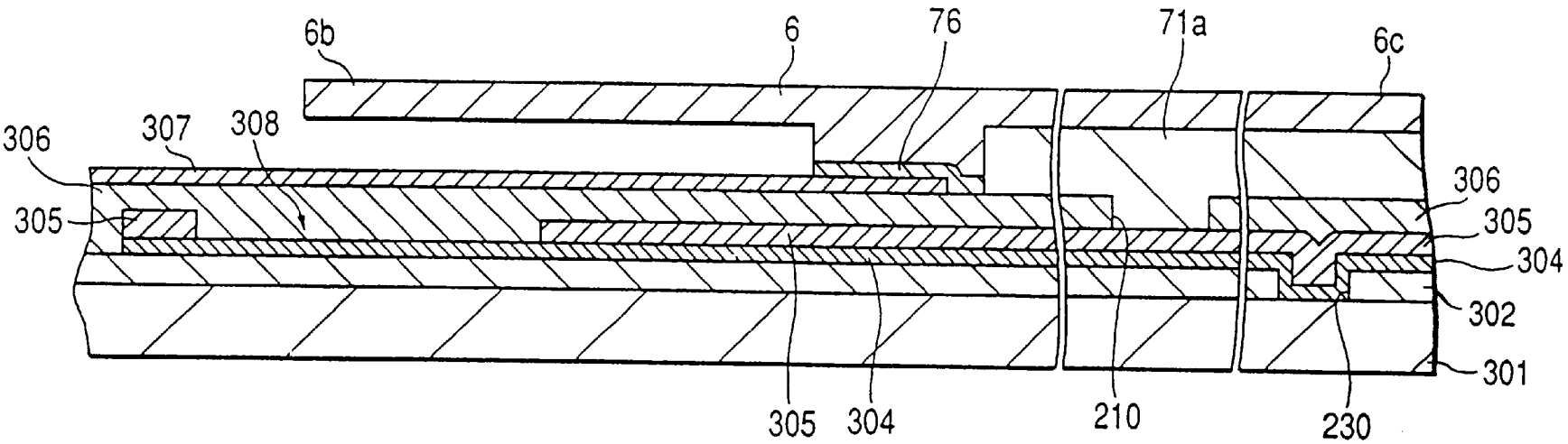
FIG. 12 is a cross-sectional view which illustrates the electric connection of the liquid discharge head in accordance with a third embodiment of the present invention, taken in the flow path direction.
Figure 13:
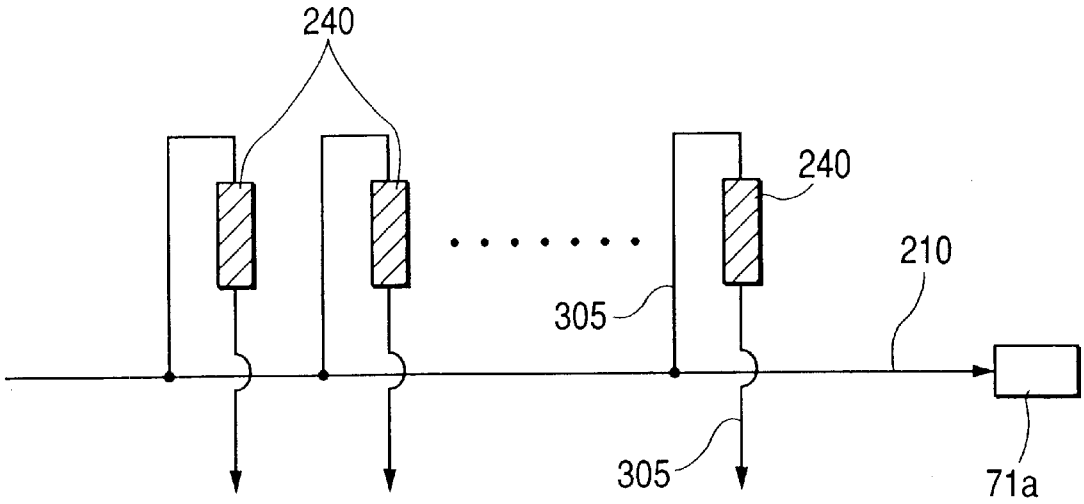
FIG. 13 is a schematic view of a circuit which illustrates the electrical connection of the liquid discharge head in accordance with the first embodiment of the present invention.
Figure 14:
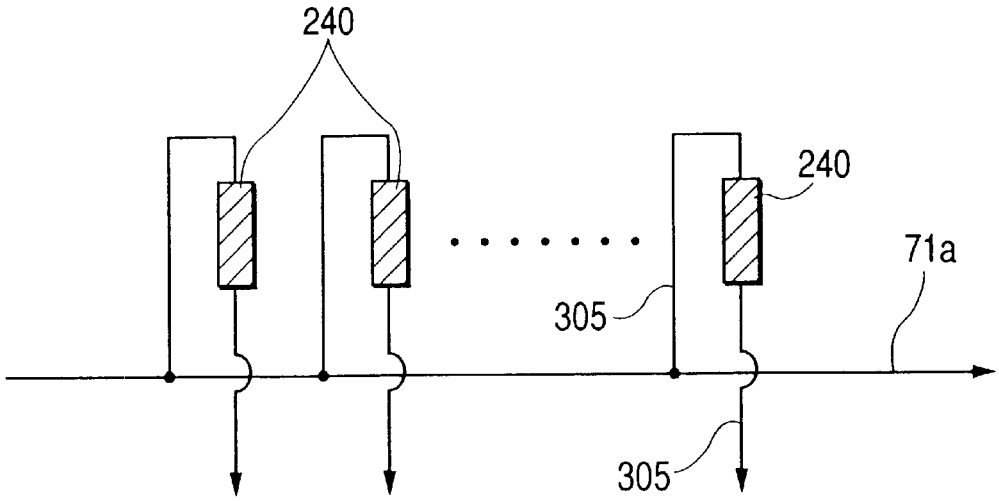
FIG. 14 is a schematic view of a circuit which illustrates the electrical connection of the liquid discharge head in accordance with the third embodiment of the present invention.

Now, with reference to FIG. 12 to FIG. 14, the description will be made of the liquid discharge head in accordance with a second embodiment of the present invention. Here, the same reference marks are applied to the same structures as those appearing in the first embodiment, and the description thereof will be omitted.

In accordance with the first embodiment, the metallic layer 71*a* that forms each of the gaps between the wiring 210 and wiring 305 is utilized as shown in FIG. 3 to electrically connect the elemental substrate 1 and the external member, the ceiling plate 3, or the like. However, for the present embodiment, the wiring 210 is omitted on one side, and then, the wiring 305 and the metallic layer 71*a* that forms each gap are allowed to be in contact directly on the through hole 201 portion as shown in FIG. 12. Also, in this structure, the wiring 210 is not present. As a result, the interlayer film 303 is not needed, either. Here, although omitted in FIG. 3, the wiring 305 is connected with a semiconductor portion, which is not shown, but formed on the elemental substrate 1 by way of the through hole 230 and the resistive layer 304. Then, with this wiring pattern, the connection is made with the transistor and other driving elements, which are not shown, either.

Now, with reference to FIG. 13 and FIG. 14, this electric connection will be described. In the case of the liquid discharge head of the first embodiment which is shown in FIG. 13 schematically, the individual connection is made between each of the heating elements 240 and the driving element, such as transistor, by use of the wiring 305. Then, the wiring 210 is used to put each of the wiring 305 together. Further, although not shown in FIG. 13, the metallic layer 71*a* that forms each gap is used as wiring to make connection with the external circuit, the ceiling plate and the like from the wiring 210. on the other hand, in accordance with the present embodiment shown in FIG. 14, the individual connection is made by the wiring 305 between each of the heating elements 240 and the driving elements, such as transistor, while the metallic layer 71*a* that forms each gap puts each of the wiring 305 together, and at the same time, connection is made with the external circuits, the ceiling plate, and the like. In other words, the metallic layer 71*a* that forms each gap is arrange to dually operate the function of the wiring 210 of the first embodiment.

As described above, in accordance with the present embodiment, the structure is made simpler, and the manufacturing process are simplified. The costs of manufacture are also reduced. Further, since the resistive layer (TaN layer) resides on the lower layer of the wiring (Al layer) 305, it becomes possible to prevent the creation of spikes by the contact between the semiconductor portions and the wiring (Al layer) 305, thus eliminating the barrier process which is needed for the prevention of Al diffusion.

In accordance with the present invention, it is possible to utilize the metallic layer that forms each of the sufficiently large gaps as the wiring layer used for electrical connection, here particularly as the common electrodes, thus making it possible to make the electric resistance significantly small. Along with this, the electrical efficiency is enhanced. Also, it is possible to implement making the apparatus smaller, and the costs of manufacture lower as well. The metallic layer that forms each gag is the member which has been used for the conventional apparatus which is provided with the movable members. Therefore, there is no need for making the manufacturing processes and structures complicated in particular. Also, by use of the metallic layer that forms each gap as wiring, the number of wiring patterns can be reduced when made on the substrate, thus making it possible to simplify the structure.

What is claimed is:

1. A micro-electromechanical device comprising:

a movable member, said movable member having a fixedly supporting portion and a movable portion; and a substrate, said substrate having said movable member secured to said substrate at said fixedly supporting portion, wherein said substrate comprises a plurality of wiring layers including a wiring layer, a heat accumulation layer, and a resistive layer, wherein a gap exists between said movable member and said substrate, said gap being opposed to a metallic layer through a first portion of said fixedly supporting portion, said first portion being near said movable portion, wherein said metallic layer serves as a wiring layer, said wiring layer being connected to the plurality of wiring layers, and wherein said metallic layer supports said movable member at a position above said substrate, and is covered by a second portion of said fixedly supporting portion which is continuous with said first portion.

2. A micro-electromechanical device according to claim 1, wherein said wiring layer is electrically connected with a plurality of wiring arranged on said substrate.

3. A liquid discharge head comprising:

an elemental substrate, said elemental substrate having said movable member secured to said substrate at said fixedly supporting portion, wherein said substrate comprises a plurality of wiring layers including a wiring layer, a heat accumulation layer, and a resistive layer;

a ceiling plate laminated on said elemental substrate;

a flow path formed between said elemental substrate and said ceiling plate; and a movable member, said movable member having a fixedly supporting portion and a movable portion, said movable portion being positioned in said flow path, a gap exists between said movable member and said substrate, said gap being opposed to a metallic layer through a first portion of said fixedly supporting portion, said first portion being near said movable portion, wherein said metallic layer serves as a wiring layer, said wiring layer being connected to the plurality of wiring layers, and wherein said metallic layer supports said movable member at a position above said substrate, and is covered by a second portion of said fixedly supporting portion which is continuous with said first portion.

4. A liquid discharge head according to claim 3, wherein a heating element for use in discharging liquid is provided corresponding to said flow path on said elemental substrate, and said wiring layer is electrically connected with said heating element through wiring.

* * * * *